US011326597B2

(12) United States Patent
Bendixen

(10) Patent No.: US 11,326,597 B2
(45) Date of Patent: May 10, 2022

(54) FOOD PRODUCT PUMP WITH IMPELLER AND STAR WHEEL

(71) Applicant: Tetra Laval Holdings & Finance S.A., Pully (CH)

(72) Inventor: Ole Bendixen, Galten (DK)

(73) Assignee: Tetra Laval Holdings & Finance S.A., Pully (CH)

( * ) Notice: Subject to any disclaimer, the term of this patent is extended or adjusted under 35 U.S.C. 154(b) by 130 days.

(21) Appl. No.: 16/641,914

(22) PCT Filed: Aug. 22, 2018

(86) PCT No.: PCT/EP2018/072670
§ 371 (c)(1),
(2) Date: Feb. 25, 2020

(87) PCT Pub. No.: WO2019/048235
PCT Pub. Date: Mar. 14, 2019

(65) Prior Publication Data

US 2020/0182243 A1 Jun. 11, 2020

(30) Foreign Application Priority Data

Sep. 6, 2017 (EP) ..... 17189623

(51) Int. Cl.
*F03C 2/00* (2006.01)
*F03C 4/00* (2006.01)
(Continued)

(52) U.S. Cl.
CPC ..... *F04C 15/0088* (2013.01); *F04C 2/101* (2013.01); *F04C 13/001* (2013.01); *F04C 15/0038* (2013.01)

(58) Field of Classification Search
CPC .. F04C 15/0088; F04C 15/0038; F04C 2/101; F04C 13/001; F01C 1/102
See application file for complete search history.

(56) References Cited

U.S. PATENT DOCUMENTS 3,015,282 A 1/1962 August
3,233,552 A * 2/1966 Kinnavy ..... F04C 2/101 418/169

(Continued)

FOREIGN PATENT DOCUMENTS

WO WO-2017005634 A1 * 1/2017 ..... F04C 15/0026

OTHER PUBLICATIONS

International Search Report for corresponding Application No. PCT/EP2018/072670, dated Oct. 30, 2018.

(Continued)

*Primary Examiner* — Theresa Trieu
(74) *Attorney, Agent, or Firm* — Renner, Otto, Boisselle & Sklar, LLP

(57) ABSTRACT

A pump for pumping a liquid food product, including a star wheel arranged to be driven by an impeller to rotate around an axis that is offset from an axis of rotation of the impeller, an element that extends between a part of the star wheel and the impeller, such that the liquid is pumped when the impeller rotates and thereby drives the star wheel. A channel is formed between the star wheel and an axle on which the star wheel is arranged, such that a part of the product may enter the channel for providing lubrication.

15 Claims, 3 Drawing Sheets

(51) Int. Cl.

| | |
|---|---|
| ***F04C 15/00*** | (2006.01) |
| ***F04C 2/00*** | (2006.01) |
| ***F04C 2/10*** | (2006.01) |
| ***F04C 13/00*** | (2006.01) |

(56) References Cited

U.S. PATENT DOCUMENTS

| | | | | | |
|---|---|---|---|---|---|
| 3,758,244 | A | * | 9/1973 | Gerber | F01C 1/102 418/169 |
| 3,876,349 | A | | 4/1975 | Svensson | |
| 3,887,310 | A | * | 6/1975 | Gerber | F04C 2/101 418/169 |
| 3,932,302 | A | * | 1/1976 | Eron | F04C 2/101 418/169 |
| 4,084,926 | A | | 4/1978 | Brodrene | |
| 5,197,869 | A | | 3/1993 | Hansen | |

OTHER PUBLICATIONS

Extended European Search Report for corresponding Application No. 17189623.6, dated Feb. 6, 2018.

* cited by examiner

FOOD PRODUCT PUMP WITH IMPELLER AND STAR WHEEL

TECHNICAL FIELD

The invention relates to a pump for pumping a liquid food product, where a star wheel is driven by an impeller that rotates around an axis that is offset from the star wheel's axis of rotation.

BACKGROUND ART

Today a number of food handling apparatuses are used in the food processing industry, such as pumps that are used for transporting the food through a food processing line. One type of food processing lines is used to produce ice cream products, which includes dairy based ice cream products as well as water-based frozen snack (ice pops). Frozen custard, frozen yogurt, sorbet, gelato and frozen dairy dessert are some product names that are used to distinguish different varieties and styles of ice cream products.

During large scale production of an ice cream product, the product is often pumped through pipes and different types of equipment that are part of the food processing line. This applies for both the finished ice cream product as well as for ice cream products (ingredients and mixtures) that eventually will form the finished ice cream product. Special pumps are often used for pumping ice cream products in form of either finished products or ingredients/mixtures that will form part of the finished product. These pumps have moving parts and, as with most pumps, there is some wear between the moving parts. The parts subjected to wear are made of safe materials that are naturally present in the human body and the wear is so small that the product does not become contaminated. However, the worn pump parts must eventually be replaced, which introduces costs and production down-time.

Since the pumped product is a food product, it is preferred to use the product itself as lubricant between the moving parts. Using solutions that employ other lubricants are often not desirable, as this introduces a risk of contaminating the pumped food product.

A number of pumps that are used for pumping food products, and in particular ice cream products, exist and are successfully lubricated with the pumped product. However, it appears that there is still some unnecessary wear between moving parts in the pump.

SUMMARY

It is an object of the invention to at least partly overcome one or more of the above-identified limitations of the prior art. In particular, it is an object to provide a pump that has an improved capability of lubricating one or more moving parts with a liquid food product that is pumped.

To solve these objects it is according to a first aspect provided a pump for pumping a liquid food product. The pump comprises: a housing having an inlet and an outlet for the product; an impeller arranged to rotate inside the housing, around a first axis; a star wheel arranged to be driven by the impeller to rotate around a second axis that is offset from the first axis; and an element that extends along a part of a periphery of the star wheel, between the star wheel and the impeller, such that the product is pumped from the inlet to the outlet when the impeller rotates and thereby drives the star wheel. The star wheel is arranged on an axis, and a channel is formed between the star wheel and the axis, such that a part of the product may enter the channel to provide lubrication. The lubrication may be provided between the star wheel and the axle, and/or between the star wheel and another component that is adjacent the star wheel.

The pump is advantageous in that the channel allows more product to enter in between the star wheel and the axis, which improves the lubrication for the rotating star wheel. The channel typically extends the full width (thickness) of the star wheel, so that product may be distributed from one side of the star wheel to the other side of the star wheel.

A first liquid passage may be formed from the outlet and between the housing and the impeller, and a second liquid passage may be formed as a through hole in the impeller, to extend between the first liquid passage and the channel. This allows product to be efficiently lead to the channel by virtue of a small backpressure that is created at a periphery of the outlet from where the first liquid passage extends.

As indicated, the first passage may extend from the outlet. From the outlet the first passage may extend further in an axial direction of the impeller, and further in a radially inward direction of the impeller.

A bushing may be arranged between the star wheel and the axis. The channel may be formed between the bushing and the axle. In one embodiment the channel may comprise a groove in the bushing. Alternatively or additionally, the channel may comprise a groove in the axis. The channel may also comprises a groove in the star wheel.

The channel may be located such that it faces, as seen in a radial direction of the second axis, a center of the element that extends between the star wheel and the impeller.

The star wheel may secured to the axis by a nut that has an opening to let product pass the nut to enter the channel.

The axis may comprise an end surface in which a groove is arranged, such that a gasket may be located in the groove. The nut may be attached to the axis at the same end that form the end surface in which the groove is arranged.

An at least partly circumferential groove may be formed around the axle, between the star wheel and the axis, said groove being arranged adjacent the channel, such that a part of the product may enter said groove to provide lubrication.

The pump may comprise a stationary support unit. The axis and the element between the star wheel and the impeller may then extend from the stationary support unit, and the star wheel may be supported by the stationary support unit in a direction that is parallel to the second axis. The at least partly circumferential groove may then be located adjacent the stationary support unit, to provide lubrication between the star wheel and the stationary support unit.

According to another aspect a kit of parts is provided. The kit of parts is configured to be used as components in a pump according to the aspect above. The kit of parts comprises: a stationary support unit from which an element and an axle extends, wherein a channel is arranged as a groove in the axle; and a nut to secure a star wheel to the axle, the nut having an opening for letting a part of the liquid product pass the nut to enter the channel. For the kit of parts the nut, the stationary support unit, the element and the axle as the same parts as described in connection with the pump, and they may include the same features as described in connection with the pump.

According to another aspect a method of pumping an ice cream product with a pump is provided. The pump is a pump according to the aspect above, and may include any of the above described features. An ice cream product-supplying component is connected to the inlet and an ice cream product-receiving component is connected to the outlet. The method comprises rotating the impeller to thereby drive the star wheel, such that the ice cream product is pumped from the inlet to the outlet, and a part of the ice cream product enters the channel to provide lubrication.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
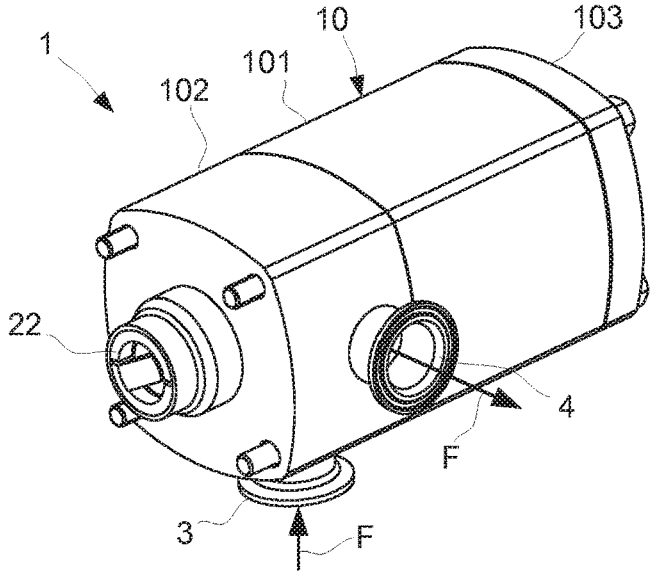
FIG. 1 is a perspective view of a pump for pumping a liquid food product.
Figure 2:
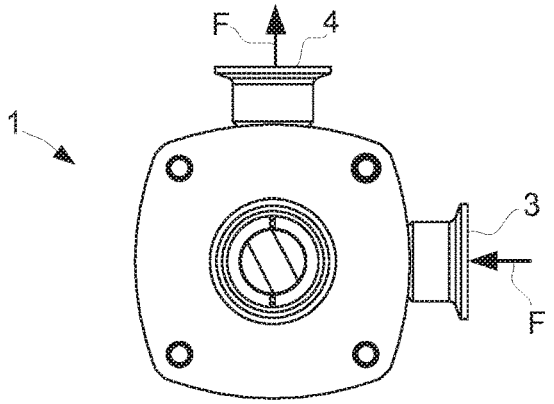
FIG. 2 is a front view of the pump of FIG. 1.
Figure 3:
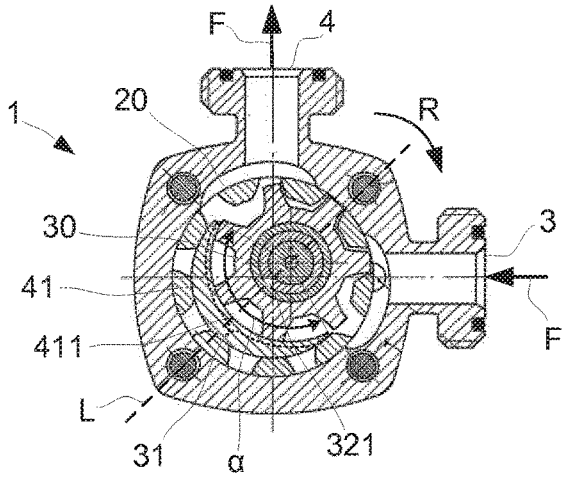
FIG. 3 is a cross sectional front view of a pump similar to the pump of FIG. 1.
Figure 4:
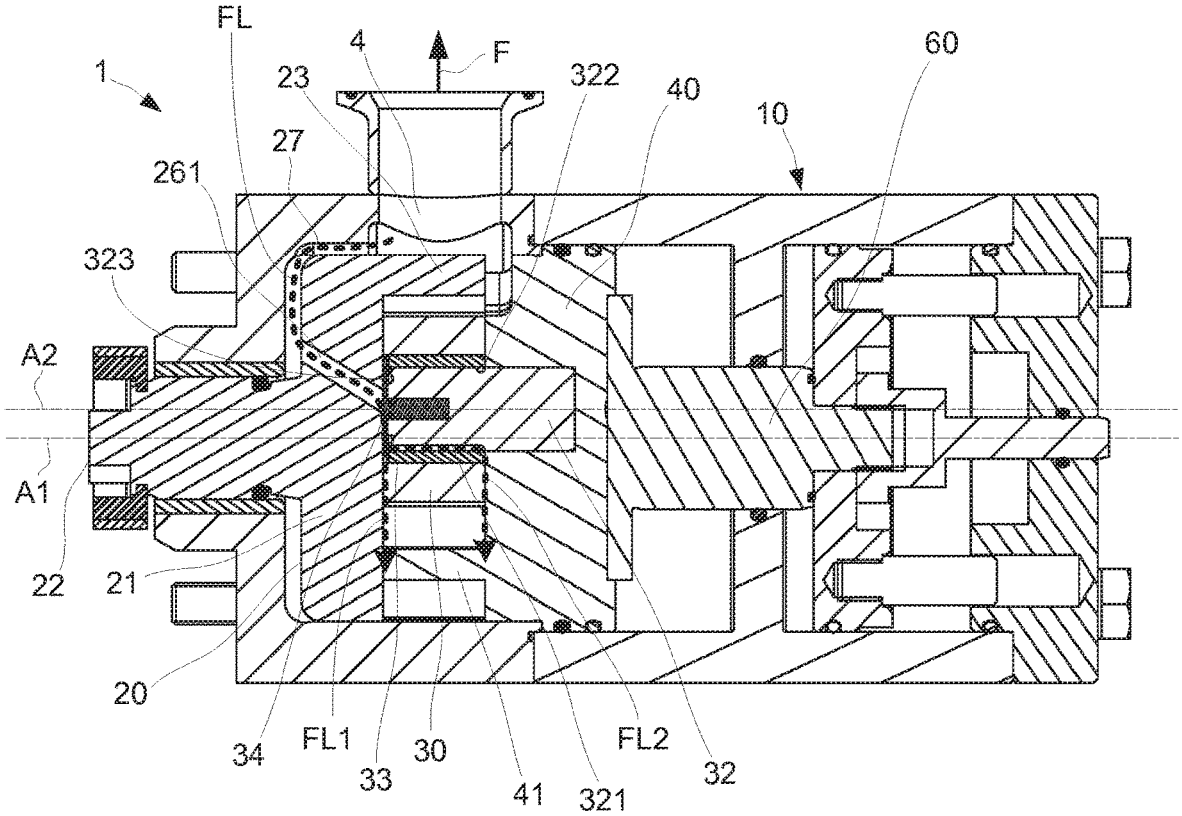
FIG. 4 is a cross sectional side view of the pump of FIG. 1.

With reference to FIGS. 1 and 2 a pump 1 for pumping a liquid food product F is illustrated. A liquid food product is food that is capable of being pumped, and is consumable by humans to provide nutritional support. The liquid food product is a product that has either its final form, or is a food product in form of a mixture or an ingredient that can be pumped and which is intended to form part of a final food product.

The pump 1 has a housing 10 that is formed by a center section 101, a first end section 102 and a second end section 103. The end sections 102, 103 are connected to a respective end of the center section 101. The connection is accomplished by conventional connection rods and bolts. The first end section has an inlet 3 and an outlet 4 for the liquid food product F.

With further reference to FIGS. 3 to 6 an impeller 20 is arranged inside the housing 10 and is rotatable around a first axis A1. The impeller 20 has a disk shaped section 21 from which an axle 22 extends out through the housing 10. A motor (not shown) may be connected to the axle 22 for rotating the impeller 20. A number of teeth 23 extend from the disk shaped section 21, on a side that is opposite the side from which the axle 22 is arranged. In the illustrated embodiment nine teeth extend from the disk shaped section 21.

A star wheel 30 is arranged inside the housing 10 and is rotatable around a second axis A2 that is offset from the first axis A1. The star wheel 30 has the principal shape of a gear with a center opening 35 and seven teeth 36 that extend in radial directions of the star wheel 30. The star wheel 30 is positioned within the teeth 23 of the impeller 20, so that some of the teeth 36 of the star wheel 30 extend into the spaces that are formed between the teeth 23 of the impeller 20 (see FIG. 3). When the impeller 20 is driven to rotate around the first axis A1, then the impeller teeth 23 engages the star wheel teeth 36 so that the star wheel 30 rotates around the second axis A2 in a rotational direction R.

An arc-shaped element 41 extends along a part of a periphery 31 of the star wheel 30, between the star wheel 30 and the impeller 20 and at a side of the star wheel 30 that is opposite where the impeller teeth 23 engages the star wheel teeth 36. The element 41 has similar thickness, or height, as the star wheel 30, and the length of the impeller teeth 23 is similar to the element's and star wheel's thickness (height). A small clearance is provided between the disk shaped section 21 of the impeller 20 and the star wheel 30 respectively the element 41.

The element 41 extends from a stationary support unit 40, in a direction from the stationary support unit 40 and into the position between the impeller 20 and the star wheel 30. The element 41 may also be referred to as a protrusion since it protrudes from the stationary support unit 40, into the position between the impeller 20 and the star wheel 30. The element 41 has an angular extension a of about 120-180 along the periphery 31 of the star wheel 30.

The star wheel 30 is arranged on an axle 32 that extends from the stationary support unit 40. The axle 32 is centered around the second axis A2 and may be attached to the stationary support unit 40 by using any suitable, conventional technique, or may be made as an integral part of the stationary support unit 40. The star wheel 30 is arranged on the axle 32 by moving the star wheel 30 over the axle 32, in a direction towards the stationary support unit 40 such that the axle 32 extends through the center opening 35 in the star wheel 30, until the star wheel 30 meets the stationary support unit 40.

The star wheel 30 meets the stationary support unit 40 as it is placed over the axle 32, and as a result the stationary support unit 40 supports the star wheel 30 along the axial direction of the axle 32, i.e. in a direction that is parallel to the second axis A2. The star wheel 30 is secured to the axle 32 by a nut 34 that is screwed into the axle 32. In the end side of the axle 32 that faces the nut 34 a groove 323 is arranged. A gasket 324 may be located in this groove 323. A bushing 33 is arranged between the star wheel 30 and the axle 32 to provide a bearing for the star wheel 30 when it rotates around the axle 32.

When the impeller 20 rotates the star wheel 30 is driven since the teeth of the impeller 20 engages those of the star wheel 30. This effects pumping of the liquid food product F from the inlet 3 to the outlet 4.

A channel 321 is formed between the star wheel 30 and the axle 32 for allowing a part of the liquid product FL2 to enter the channel 321. This provides lubrication between components that are adjacent the channel 321. For example, if the star wheel 30 is arranged directly on the axle 32, then the channel 321 provides lubrication between the star wheel 30 and the axle 32. If a bushing 33 is arranged on the axle 32, then the channel 321 may provide lubrication between the axle 32 and bushing 33.

A first liquid passage 27 is formed from the outlet 4, at the very beginning of the outlet 4 and close to the periphery of the impeller 20, and extends from the outlet 4 and in between the housing 10 and the impeller 20. The first liquid passage 27 extends first from the outlet 4 and in an axial direction of the impeller 20, along the periphery of the impeller 20 and in a direction from the impeller teeth 23 to the impeller axle 22. Thereafter the first liquid passage 27 continues to extend in a radially inward direction of the impeller 20.

A second liquid passage 261 is formed as a through hole in the impeller 20. The second liquid passage 261 extends between the first liquid passage 27 and the channel 321. The second passage 261 may be formed as two or more, such as three, through holes 261, 262, 263 in disk 21 of the impeller 20. The through holes 261, 262, 263 are rotationally balanced.

The second liquid passage 261 extends in an axial and radially inward direction of the impeller 20. It may also be said that the second liquid passage 261 is slanted inwards in a direction to the axle 32.

The star wheel 30 is rotatable relative the axle 32 and abuts the stationary support unit 40. When product F is pumped by rotating the impeller 20 a small backpressure is created at the circumference of the outlet 4, at the border between the periphery of the impeller 20 and the outlet 4. This causes a small part of the liquid product FL to be drawn into the first liquid passage 27 and further into the second liquid passage 261.

A first part FL1 of this liquid then flows past the nut 34 and further into the space between the teeth 23 of the impeller 20 and the teeth 36 of the star wheel 30. When liquid enters this space in between the teeth 23, 36, it is again pumped to the outlet 4.

A second part FL2 of the liquid that due to the back pressure is drawn into the first liquid passage 27 passes an opening 341 in the nut 34. The opening 341 in the nut 34 is aligned with the channel 321 so that the second part of the liquid product FL2 can flow past the nut 34 and into the channel 321. The second part of the liquid product FL2 exits the channel 321 by flowing out in between the star wheel 30 and the stationary support unit 40, which thereby provides lubrication between the star wheel 30 and the stationary support unit 40. This lubrication has a great advantage in that the wear of both the star wheel 30 and the stationary support unit 40 is reduced.

If a bushing 33 is used, then the channel may be formed between the bushing 33 and the axle 32. Specifically, the channel may be formed as a groove in the bushing 33. Alternatively or additionally, the channel 321 may comprise a groove in the axle 32, and/or a groove in the star wheel 30. In the illustrated embodiment the channel 321 is shown as a groove in the axle 32.

The channel 321 is located such that it faces, as seen in a radial direction of the second axis A2, a center 411 of the element 41. The center 411 of the element 41 is the middle of the element 41, in the sense that the angular distance β from each edge of the element 41 is equal. The element 41 is arc-shaped and the edges from where β is measures form the ends of the arc. The first axis A1, the second axis A2, the channel 321 and the center 411 of the element 41 are aligned along a line L (see FIG. 3) that is perpendicular to each of the first and second axes A1, A2.

An at least partly circumferential groove 322 is formed between the star wheel 30 and the axle 32. In the illustrated embodiment the groove 322 extends around the axle 32, i.e. is a fully circumferential grove. The groove 322 may be ring-shaped, so that the grove is an annular groove that extends all around the axle 32. The groove 322 is located at the base of the axle 32, where the axle 32 meets the stationary support unit 40. The groove 322 is located adjacent the channel 321, such that the part of the liquid FL2 that enters the channel 321 continues into the groove 322. This effectively distributes liquid product FL2 around the axle 32 and further in between the star wheel 30 and the stationary support unit 40.

In operation, the pump 1 must typically be cleaned at regular intervals. The stationary support unit 40 and hence also the element 41 and the axle 32 are then retracted in a direction away from the impeller 20. The flow resistance through the pump 1 is then reduced and some parts of the pump 1 that needs to be cleaned are more efficiently exposed to the cleaning fluid. A retraction mechanism 60 is connected to the stationary support unit 40 for accomplishing the retraction.

The stationary support unit 40 with the element 41 and the axle 32 form with the nut 34 a kit of parts. This kit of parts may be used to retrofit similar pumps that already include the other parts of the pump 1. In this way the operational life time may be extended for may pumps that are used today. Examples of conventional pumps that may be retrofitted with the kit of parts are the freezer pumps sold by Tetra Pak® under the names "FP1", "FP2", "FP3" and "FP4".

Figure 7:
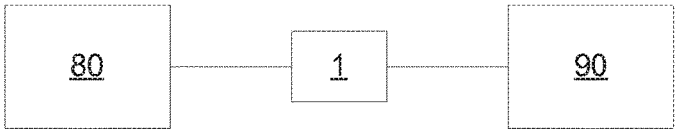
FIG. 7 is a schematic view system that is capable of pumping an ice cream product by using the pump of FIG. 1.
Figure 5:
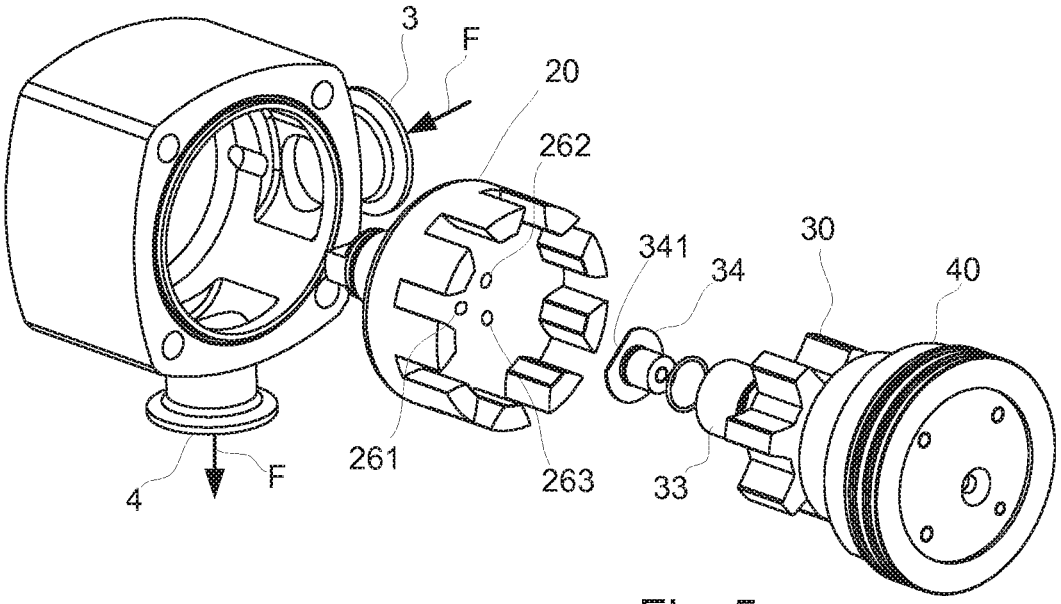
FIG. 5 is an exploded view of the pump of FIG. 1, showing some major parts of the pump from a first perspective, FIG. 6 corresponds to FIG. 5, but showing the major parts from a second perspective.
Figure 6:
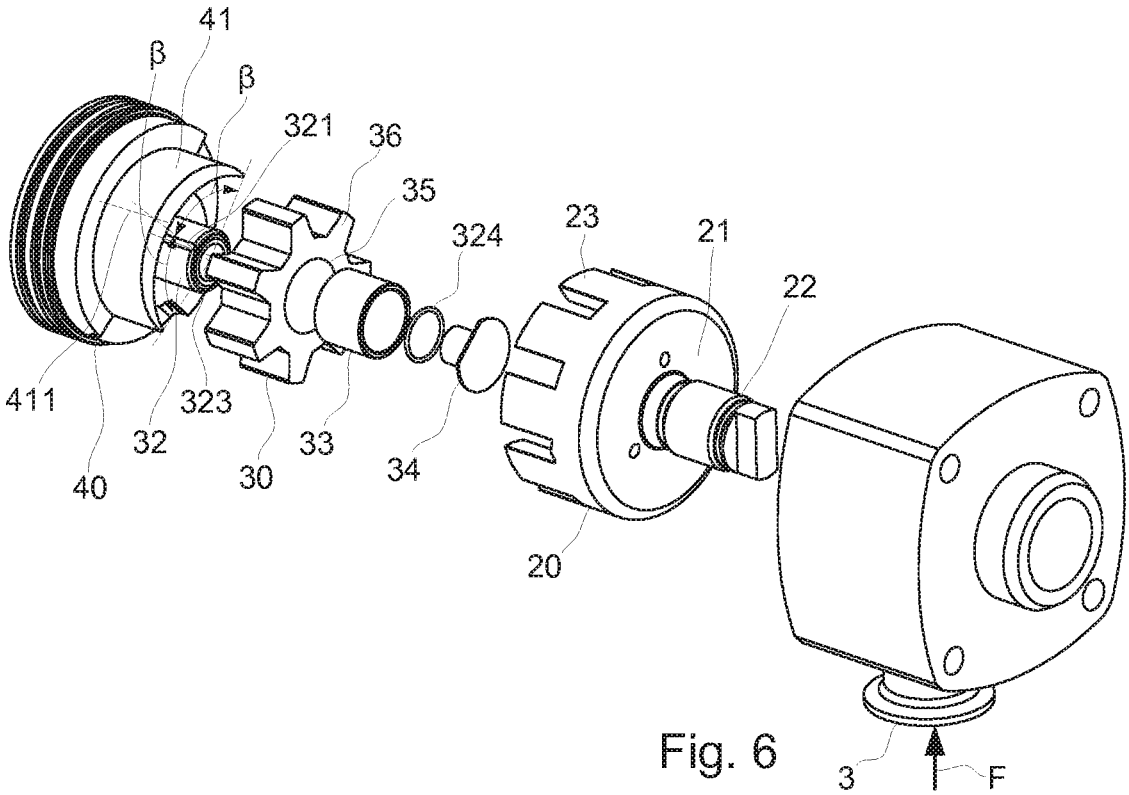

With reference to FIG. 7 the pump 1 is particularly advantageous when pumping an ice cream product, since the lubrication provided by the channel 321 has shown that ice cream products can be pumped for longer time before parts has to be replaced due to wear. The method uses the pump 1 described above, where an ice cream product-supplying component 80 is connected to the inlet 3, and an ice cream product-receiving component 90 is connected to the outlet 4. The ice cream supplying and receiving components 80, 90 may be any conventional components that may be connected to the pump, such as piping or any other conventional equipment that is part of a processing line for producing ice cream. The method comprises rotating the impeller 20 to thereby drive the star wheel 30. This effects pumping of the ice cream product F from the inlet 3 to the outlet 4, while simultaneously causing a part of the ice cream product FL2 to enter the channel 321 to provide lubrication.

From the description above follows that, although various embodiments of the invention have been described and shown, the invention is not restricted thereto, but may also be embodied in other ways within the scope of the subject-matter defined in the following claims.

The invention claimed is:

1. A pump for pumping a liquid food product, the pump comprising:

a housing having an inlet and an outlet for the liquid food product, an impeller arranged to rotate inside the housing, around a first axis, a star wheel arranged to be driven by the impeller to rotate around a second axis that is offset from the first axis, a stationary support having a protrusion that extends along a part of a periphery of the star wheel, between the star wheel and the impeller, such that the liquid food product is pumped from the inlet to the outlet when the impeller rotates and thereby drives the star wheel, wherein the star wheel is arranged on an axle, and a channel is formed between the star wheel and the axle, such that a part of the liquid food product enters the channel for providing lubrication, wherein an at least partly circumferential groove is formed around the axle, between the star wheel and the axle, said at least partly circumferential groove being arranged adjacent the channel, such that a part of the liquid food product enters said at least partly circumferential groove for providing lubrication.

2. The pump according to claim 1, wherein a first liquid passage is formed from the outlet and between the housing and the impeller, and a second liquid passage is formed as a through hole in the impeller, between the first liquid passage and the channel.

3. The pump according to claim 2, wherein the first liquid passage extends from the outlet, further in an axial direction of the impeller, and further in a radially inward direction of the impeller.

4. The pump according to claim 1, wherein a bushing is arranged between the star wheel and the axle.

5. The pump according to claim 4, wherein the channel is formed between the bushing and the axle.

6. The pump according to claim 1, wherein the channel comprises a groove in the axle.

7. The pump according to claim 1, wherein the channel comprises a groove in the star wheel.

8. The pump according to claim 1, wherein the channel is located such that it faces, as seen in a radial direction of the second axis, a center of the protrusion between the star wheel and the impeller, wherein the center of the protrusion is the middle defined by the angular distance from each edge of the protrusion being equal.

9. The pump according to claim 1, wherein the star wheel is secured to the axle by a nut that has an opening to let liquid pass the nut to enter the channel.

10. The pump according to claim 1, wherein the axle comprises an end surface in which a groove is arranged, such that a gasket is configured to be located in the groove.

11. The pump according to claim 1, wherein the axle extends from the stationary support, the star wheel is supported by the stationary support in a direction that is parallel to the second axis, and the at least partly circumferential groove is located adjacent the stationary support, for providing lubrication between the star wheel and the stationary support.

12. A kit of parts configured to be used in the pump according to claim 1, the kit of parts comprising:

the stationary support from which the axle extends, wherein the channel is arranged as a groove in the axle, and a nut to secure the star wheel to the axle, the nut having an opening for letting a part of the liquid product pass the nut to enter the channel.

13. A method of pumping an ice cream product with a pump according to claim 1, wherein the inlet is configured to receive the ice cream product from an ice cream product-supplying part of an ice cream processing line upstream the pump, and wherein an ice cream product-receiving part of the ice cream processing line downstream the pump is configured to receive the ice cream product from the pump through the outlet, the method comprising:

rotating the impeller to thereby drive the star wheel, such that the ice cream product is pumped from the inlet to the outlet, and a part of the ice cream product enters the channel for providing lubrication.

14. A pump for pumping a liquid food product, the pump comprising:

a housing having an inlet and an outlet for the liquid food product, an impeller arranged to rotate inside the housing, around a first axis, a star wheel arranged to be driven by the impeller to rotate around a second axis that is offset from the first axis, a stationary support having a protrusion that extends along a part of a periphery of the star wheel, between the star wheel and the impeller, such that the liquid food product is pumped from the inlet to the outlet when the impeller rotates and thereby drives the star wheel, wherein the star wheel is arranged on an axle, a channel is formed between the star wheel and the axle, such that a part of the liquid food product enters the channel for providing lubrication, and the star wheel is secured to the axle by a nut that has an opening to let liquid pass the nut to enter the channel.

15. A kit of parts configured to be used in a pump for pumping a liquid food product, the pump comprising a housing having an inlet and an outlet for the liquid food product, an impeller arranged to rotate inside the housing, around a first axis, a star wheel arranged to be driven by the impeller to rotate around a second axis that is offset from the first axis, wherein the liquid food product is pumped from the inlet to the outlet when the impeller rotates and thereby drives the star wheel, the star wheel is arranged on an axle, and a channel is formed between the star wheel and the axle, such that a part of the liquid food product enters the channel for providing lubrication, the kit of parts comprising:

a stationary support having a protrusion that extends along a part of a periphery of the star wheel, between the star wheel and the impeller, the axle extending from the stationary support, wherein the channel is arranged as a groove in the axle, and a nut to secure the star wheel to the axle, the nut having an opening for letting a part of the liquid product pass the nut to enter the channel.

* * * * *